United States Patent [19]

Degen

[11] 4,403,357

[45] Sep. 13, 1983

[54] RECLINING FURNITURE

[75] Inventor: Hugo Degen, Seltisberg, Switzerland

[73] Assignee: Inpaver AG, Zug, Switzerland

[21] Appl. No.: 207,843

[22] Filed: Nov. 18, 1980

[30] Foreign Application Priority Data

Nov. 28, 1979 [CH] Switzerland ..... 10590/79

[51] Int. Cl.[3] ..... A61G 7/00

[52] U.S. Cl. ..... 5/66; 5/69

[58] Field of Search ..... 5/62, 66–69; 297/320, 460; 216/379, 385, 388

[56] References Cited

U.S. PATENT DOCUMENTS

| | | | |
|---|---|---|---|
| 525,959 | 9/1894 | Martin | 5/62 |
| 2,337,395 | 12/1943 | Leland, Jr. | 5/69 |
| 2,500,742 | 3/1950 | Taylor | 5/69 |
| 3,312,985 | 4/1967 | Callaghan | 5/66 |
| 3,540,777 | 11/1970 | Beaumont | 297/460 |
| 3,703,742 | 11/1972 | Konishi | 16/385 |
| 3,974,530 | 8/1976 | Lusch et al. | 5/66 |
| 4,057,873 | 11/1977 | Bursani | 16/388 |

FOREIGN PATENT DOCUMENTS

| | | | |
|---|---|---|---|
| 1295987 | 5/1962 | France | 5/68 |
| 13957 | of 1891 | United Kingdom | 16/388 |

*Primary Examiner*—Francis K. Zugel
*Assistant Examiner*—Michael F. Trettel
*Attorney, Agent, or Firm*—Neil F. Markva

[57] ABSTRACT

The frame of an article of reclining furniture supports an under-mattress which comprises a back member, a thigh member and a foot member. The back member is mounted for pivotal movement about an axis in such a manner that upon pivotal displacement the inner end portion thereof is moved under the pivot axis and forms a sitting depression. An intermediate member is freely inserted between the back member and the thigh member. This intermediate member is suspended at the adjacent ends of the back member and the thigh member by joints. Therefore, together with the back member and the thigh member, which is movable with the foot member longitudinally of the article, the intermediate member forms a system of joints which responds to magnitude and point of attack of the load and compensates for anatomical differences and permits the occupant any desired change of his sitting position. Depending upon whether the person changes his position forwards or backwards, the intermediate member will be flush with the back member or the thigh member and thereby ensure always a correct support of the entire spine. The movable connection of the intermediate member with the adjacent ends of the back member and the thigh member is effected preferably by an elastic joint whose two limbs of which include teeth, so that in its closed position the joint may absorb without difficulty even vertical continuous loads.

6 Claims, 9 Drawing Figures

FIG.6
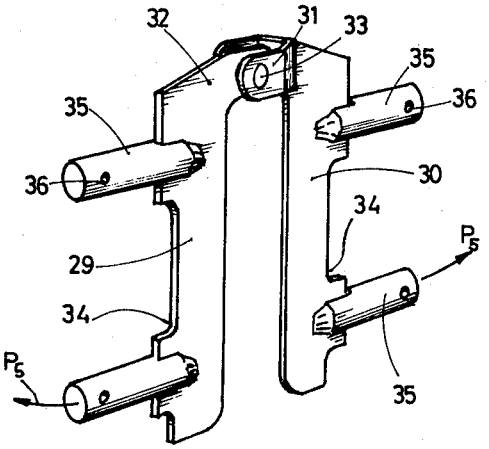
FIG.8
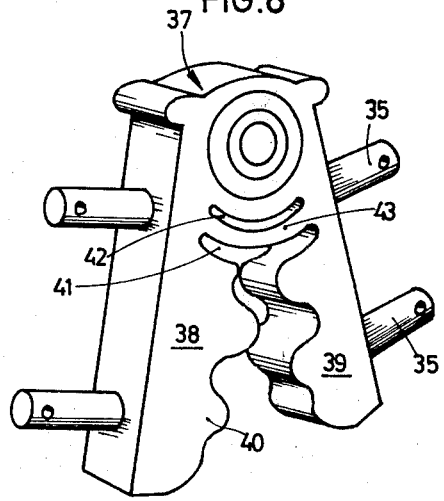
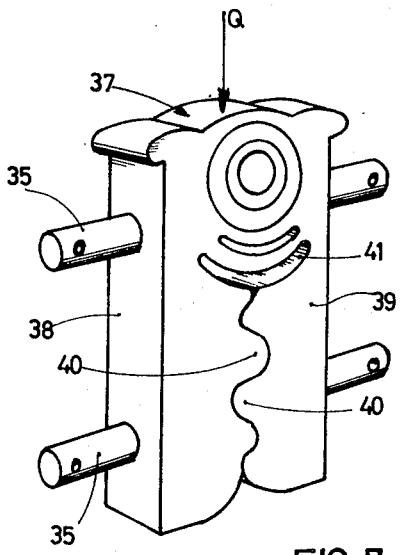
FIG.7

RECLINING FURNITURE

FIELD OF THE INVENTION

The invention relates to an article of reclining furniture having a rigid frame and an under-mattress which is movably mounted therein. A back member is pivotal about a horizontal axis and a thigh member is pivotally connected thereto. Likewise a foot member is pivotal about a horizontal axis and is mounted displaceable in the frame in the direction of the longitudinal axis of the article of reclining furniture, for the purpose of compensating the length.

BACKGROUND TO THE INVENTION

There exist already a series of articles of reclining furniture, in particular beds, which comprise a back member whose inclination is adjustable, so that a correct sitting position in the bed is rendered possible. In contrast to the relatively short head member which has been known for a long time, the back member extends over the entire length of the back and is pivotally jointed at the lower end. As shown in FIG. 1 of the accompanying drawings, in a known construction the back member 1 is connected by means of a pivot joint 2*a*, on both sides of the under-mattress, to a stationary middle member 3 which is securely fastened to the frame 4 of the bed. A thigh member 6 is connected to the middle member 3 by means of a further pivot joint 2*b*; the thigh member 6, in turn, is pivotally connected to a foot member, the second part of a two-part construction and is laterally guided in the frame 4 by means of pins 7. Lifting and lowering the movable members 1 and 6 is effected mostly by means of one or two motors (not illustrated).

In this kind of adjustable bed the back member 1 can therefore be moved to any desired inclined position by actuation of a motor, until the desired sitting position has been attained. However, as everybody knows from experience, this sitting position is not a fixed position which one assumes once and for all and then maintains. Because, on the one hand, the occupant of the bed will always have the tendency to slide on the middle member 3 in the direction of the arrow P; on the other hand, the rigid maintenance of a position once assumed is unpleasant in the long run, so that the occupant searches involuntarily for a change of position, even if it is merely a minor one.

Such a variation of the sitting position is practically impossible by means of the apparatus according to FIG. 1, unless a less comfortable and less advantageous position is accepted; namely the occupant's back is obviously fully supported only in the position in which he has slid completely backwards, his seat abutting the lower section of the back member 1. Any deviation from this position imports release from the supporting surface of the back member and thereby the tendency to strains and damage to the spine.

A further disadvantage of this known construction resides in that the upper mattress which is located on the under-mattress is severely angled in the region of the pivot joint 2*a* in the sitting position and slides on the under-mattress with every change of position of the occupant. It is thus very difficult for the occupant to find and maintain the anatomically correctly supporting position which is right for him.

What is therefore desired is an article of reclining furniture which permits a lying position and in addition thereto a perfect sitting position which adjusts itself automatically to the occupant upon minor changes of the sitting position and which ensures in every position anatomically correct support of his body.

SUMMARY OF THE INVENTION

The present invention provides an article of reclining furniture with a rigid frame and an under-mattress movably mounted therein. A back member pivots about a horizontal axis and a thigh member is pivotally connected thereto. Likewise the foot member is pivotally connected to the thigh member and is pivotal about a horizontal axis. The foot and thigh member are mounted displaceable in the frame in the direction of the longitudinal axis of the article of reclining furniture for the purpose of length compensation. The horizontal pivot axis of the back member is located in the region between the two end portions thereof. The inner end portion of the back member is connected to the adjacent end portion of the thigh member by an intermediate member which is freely suspended from the two end portions by pivot joints having a horizontal pivot axis.

In the present context, the terms "foot member" and "thigh member" are to be so understood that they together comprise the section of the under-mattress which serves substantially for supporting the legs. This leg supporting section may be in one or two parts, and together with the back member it serves for receiving the upper mattress.

BRIEF DESCRIPTION OF THE DRAWINGS

Other objects of this invention will appear in the following description and appended claims, reference being made to the accompanying drawings forming a part of the specification wherein like reference characters designate corresponding parts in the several views.

FIG. 6 is a perspective view of the metal fixing elements of an elastic pivot joint; and FIGS. 7 and 8 illustrate in perspective the entire pivot joint in the closed and in the spread-open state, respectively.

DESCRIPTION OF PREFERRED EMBODIMENTS

Figure 2:
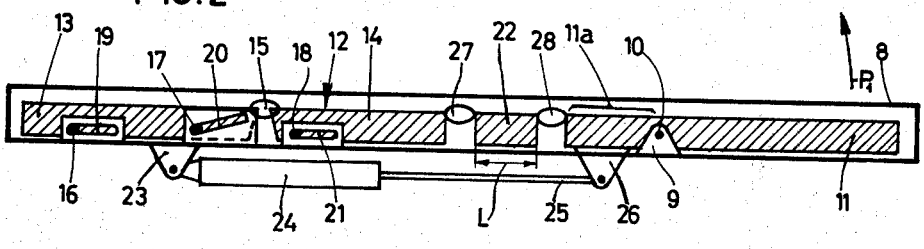
FIGS. 2, 3, 4, and 5 are simplified vertical sections of an under-mattress arranged on a frame, in various positions, in a bed according to the invention.
Figure 3:
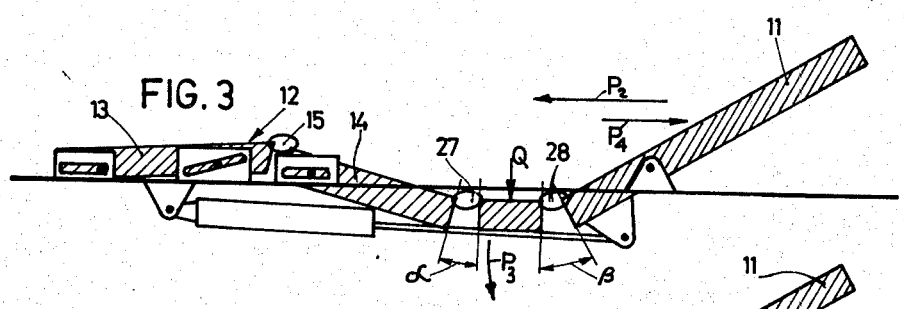

Referring first to FIGS. 2 and 3, a rigid frame 8 of an article of reclining furniture (referred to below as a bed) in the usual manner comprises two longitudinal frame members which are connected together by means of transverse struts. Each longitudinal frame member of the frame 8 has a pivot bearing 9 attached to it. Back member 11 of an under-mattress is mounted in the bearings 9 by means of pivot pins so that it is rotatable about the common horizontal axis 10 of the pivot pins.

In contrast to the construction presently still used most frequently, the pivot axis 10 of the back member is not arranged at the inner end of the back member 11, but between its two end portions, i.e. at a distance 11*a* from the inner edge of the back member edge. When the back member 11 is swung upwards in the direction of the arrow P1 the portion 11*a* of the back member which is located within the pivot axis 10 travels under the normal plane of lying (compare in this context also FIGS. 3 and 4).

The leg supporting portion 12 (FIG. 2) of the under-mattress consists, in the embodiment illustrated, of two portions, namely, boot member 13 and thigh member 14 which are pivotally connected to each other about the common axis of a pair of pivot joints 15. Pins 16, 17, and 18 which project from both sides of the leg supporting portion 12 are slidingly guided in guide rails 19, 20, and 21 which are fastened to the inner surfaces of the longitudinal frame members of the frame 8. Thus upon displacement, foot portion 13 assumes an inclined position in accordance with the inclination of the guide rails 20. Simultaneously the thigh portion 14 is rotated about the common axis of the pins 18.

Figure 2A:
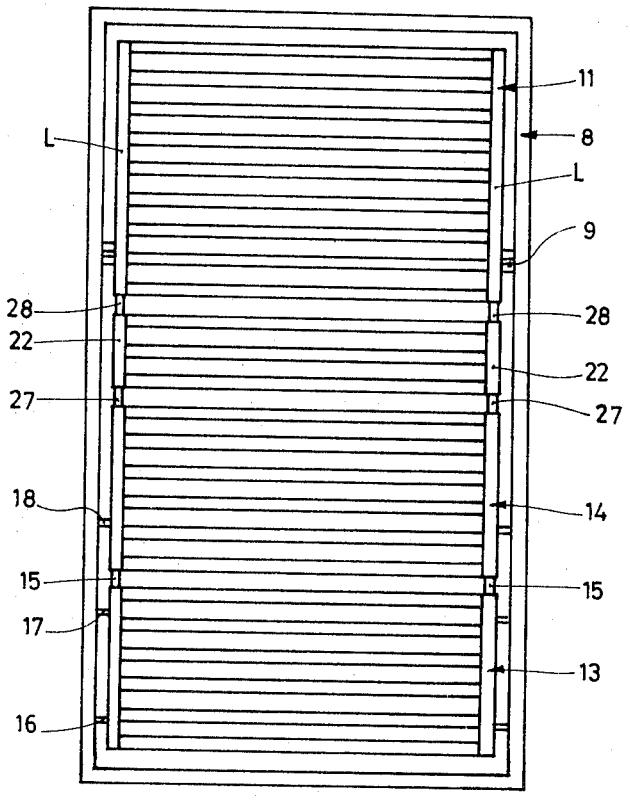
FIG. 2*a* is a plan view of the bed in the position according to FIG. 2.

As shown in FIGS. 2 to 5, the mutually facing inner ends of the back member 11 and the thigh member portion 14 are not connected to each other directly, but with the interposition of an intermediate member constituted by a pair of elements 22. Although each individual intermediate element 22 could extend over the entire width of the under-mattress, in the embodiment selected it is arranged merely in the extension of the two longitudinal frame members L of the back member 11 (FIG. 2*a*). The two intermediate elements 22 are connected one to the other by at least one transverse strut Q. Each intermediate element 22 is connected to the adjacent ends of the back member 11 and the thigh member portion 14 by means of pivot joints 28 and 27, respectively, which are preferably constructed as elastic pivot joints. Thus the two intermediate elements 22 of the under-mattress are connected in a freely suspended manner to the adjacent portions 11, 14 by means of the pivot joints 27, 28. The length L (FIG. 2) of the intermediate member lies preferably between 1/5 and 1/10 of the total length of the back member 11 and in a preferred embodiment it amounts to approximately 1/6 thereof. Furthermore, a motor 24 is pivotally connected to the frame 8 below the frame by means of a bearing 23, and a driving rod 25 thereof engages the inner end portion of the back member 11 by way of a bearing 26.

The functioning of the under-mattress is described below with reference to FIGS. 3 to 5.

When the occupant of the bed wishes to transfer from the lying position (FIG. 2) to a sitting posiion (FIG. 4 or FIG. 5), the motor 24 is actuated and thereby the back member 11 is swung in the direction of the arrow P1 (FIG. 2). In this case the freely suspended intermediate member (pair of elements 22) has the possibility to assume different positions under different loads and thereby to adjust itself to different sitting positions as well as anatomic differences in the body construction (e.g. different length of the thighs). That is, the intermediate member is freely responsive to the positions of the back member and the thigh member.

Figure 1:
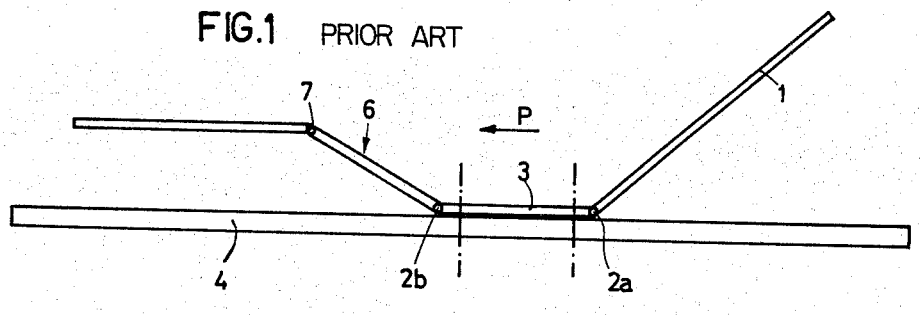
FIG.1 PRIOR ART
FIG. 1 is a diagrammatic side view of a bed according to the prior art.

According to FIG. 3, the intermediate member so to speak assumes an intermediate position in which the two angles $\alpha$ and $\beta$ which it forms with the adjacent portions are substantially equal. The intermediate member will assume this position when the load Q exerted on it by the occupant acts substantially in the center, i.e. the main weight of the occupant is transmitted through his seat to a transverse strut which connects together the centers of the two elements 22 of the intermediate member. This position once selected, however, is not maintained by the occupant, as experience shows. As everybody knows or can detect by observing himself, he will try to attain a change of position, mostly even after sitting for 10 to 5 minutes; when the known under-mattress was used, e.g. according to FIG. 1, this was possible only by abandoning correct body support and accepting straining positions. Thanks to the interposition of the intermediate member this is different in the present case. For example, if the occupant slides his seat slightly forwards in the direction of arrow P2, the intermediate member will yield in the direction of the arrow P3 (FIG. 3), in order to assume finally the position in accordance with FIG. 4 when the load in the direction stated persists.

This "yielding" of the intermediate member does not depend only upon the load Q and its point of action, because the intermediate member is connected to the adjacent under-mattress portions 11, 14 by means of the pivot joints 27,28 to form a movable system. Thus the intermediate member is acted upon by the load Q and additionally by the tension exerted by the back member 11 as well as the tension exerted by the thigh member 6 which depends upon the weight of the resting legs and which can be influenced by the occupant by stretching or special loading of the leg parts.

Figure 4:
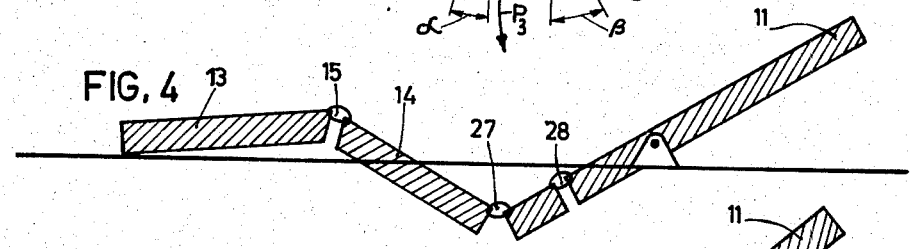

If then the position of the intermediate member in accordance with FIG. 4 is considered, it will be seen that it has functionally correctly reacted under the influence of the displacement of the load in the direction P2 (FIG. 3) and has allocated a different place to the occupant's seat, the support of his spine remaining ensured as before along its entire supportable length.

Figure 5:
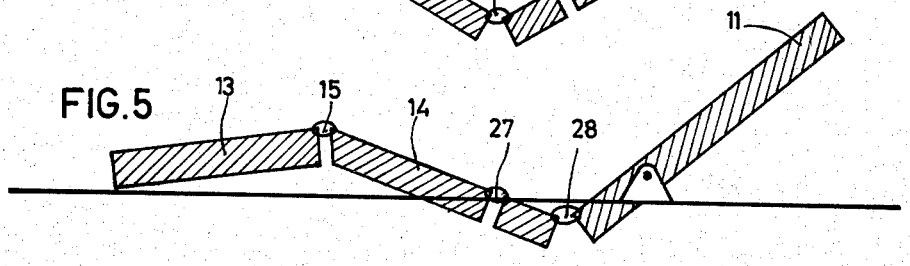

If, in contrast, the occupant had felt the need to slide his seat from the inclined postion according to FIG.2 further back in the sense of the arrow P4 (FIG. 3), in order to obtain a steeper angle of the back member 11 and a more favorable load situation in the region of the intermediate member, the final result would have been the sitting position according to FIG. 5. Here his seat, on the one hand, is shifted in the direction P4 as desired; on the other hand, the back member 11, the intermediate member, and the thigh member 6 have adjusted themselves to the new load position in such a manner that in this case again the most comfortable sitting position with complete supporting of the spline has been obtained.

Thus the intermediate member permits automatic adjustment of the prevailing sitting position to any desired load conditions; in addition to displacement of the center of gravity, the occupant can influence this also by stretching his legs, particular loading of the thigh member or the back member, etc.

Even if such an article of reclining furniture may be used with advantage as an article of sitting furniture, use thereof in the sitting position has been shown by experience to stand back far behind the normal extended position or sleeping position. In other words, the under-mattress is loaded daily for probably 1 hour in the sitting position, but 7 hours in the extended lying position. It would therefore be of great advantage if the joints 27 and 28 in the extended position according to FIG. 2 were able to receive even large vertical constant loads with certainty. Furthermore it would be desirable if the mutually displaceable parts 11 and 22 in the extended position were connected together automatically to form a rigid unit. This double target is reached by a special form of joint which is illustrated in FIGS. 6 to 8.

The embodiment illustrated in FIGS. 6 to 8 shows two metal fixing elements i.e. two plate-like steel limbs 29 and 30. Fork-like lateral projection 31 on limb 30 engages over an upper angled part 32 of the other steel limb 29. At the place of overlap, the two limbs 29 and 30 are pivotally connected together by a pin 33 and thus may be rotated about the axis of the pin 33 in the sense of the double-arrow P5. The outer flanks of limb 29 and 30 include recesses 34 and fixing pins 35 which permits the limbs to be securely anchored at the ends of two adjacent longitudinal frame member sections. Referring to FIG. 2, the fixing pins 35 are thus fixed in the mutually facing end surfaces of the back member 11 and the intermediate elements 22 on the one hand, and in the mutually facing end surfaces of the intermediate elements 22 and the foot member portion 14 on the other hand. In this embodiment, pins 35 are cylindrical and have transverse bores 36 for retention by pins, but obviously any other kind of fixing could be selected which is available to the expert without further difficulty.

In order to obtain an elastic connection of the two limbs 29 and 30, they are surrounded by a jacket 37, except for the outer ends of the pins 35, as shown in FIG. 7. This jacket 37, which is of rubber or an elastic synthetic resin material, surrounds completely the upper portion of the joint and is divided into two limbs 38,39 in the lower portion. The mutually facing surfaces of the two limbs 38 and 39 are of wavy construction in the separating face of the two limbs 38,39, so that interengaging arcuate teeth 40 are produced. In this way the joint may reliably receive in the closed state even vertical forces Q in accordance with FIG. 7. By the corrugation of the separating face and the formation of the teeth 40 (which, by the way, may alternatively have another shape) there results on the one hand, in vertical projection, a relatively large acceptance surface for vertical continuous loads. On the other hand, a rigid connection of the mutually adjacent parts of the under-mattress is produced in this way in the extended position according to FIG. 2. Also damage to the bed linen by clamping is avoided with certainty and the risk of accident (clamping a finger) is considerably reduced, since the elastically suspended intermediate member yields.

As shown in FIGS. 7 and 8, the wavy separating interface of the two limbs 38 and 39 terminates in an arcuate continuous slot 41; above the slot a non-continuous arcuate groove 42 is provided on both sides. Thereby a stay 43 is located between the slot 41 and each groove 42 and operates as an elastic restoring member when the joint is spread apart, but produces an outwardly directed counter-pressure when the joint is being compressed.

By the insertion of the intermediate member, on the one hand the undesired strong folding of the upper mattress in the sitting position is avoided, and on the other hand the unpleasant sliding away of the upper mattress is limited to a minimum. Since the intermediate member is suspended between the back member and the thigh member is a swinging manner, always the anatomically correct support position for seat and back of the occupant is obtained dependently upon the magnitude and the point of attack of the load, and in particular in the case of changes of position, it swings automatically to a new support situation which is likewise anatomically correct.

I claim:

1. An article of reclining furniture comprising:

(a) a frame and an under-mattress movably mounted on the frame, (b) the under-mattress including a back member, a foot member, a thigh member and an intermediate member, (c) the pivotable back member having an inner end portion, an outer end portion, and a horizontal pivot axis between said end portions, (d) the foot member being pivotable about a horizontal axis and mounted for displacement in the frame longitudinally of the article and being pivotally connected to one end of the thigh member, (e) the intermediate member being connected to the inner end portion of the back member with a pivot joint and to an adjacent inner end portion of the thigh member with another pivot joint at the end of the thigh member opposite the pivotal connection to the foot member, and (f) the pivot joints have horizontal pivot axes and freely suspend the intermediate member from said two inner end portions respectively so that the intermediate member is freely responsive to the positions of the back member and the thigh member.

2. The article as defined in claim 1, wherein each pivot joint comprises two coupling members pivotally connected together in an upper region, the coupling members having mutually facing surfaces having coupling elements that interengage in the closed position of the pivot joint and are effective to absorb vertical loads acting upon the pivot joint.

3. The article as defined in claim 2, wherein the mutually facing surface of the two coupling members have coverings of elastic material in which the coupling elements are formed.

4. The article as defined in either claim 3 or 4 wherein the coupling elements interengage only when the portions connected by the pivot joint are in line.

5. The article as defined in claim 1, wherein considered in the longitudinal direction of the article, the intermediate member extends over a minor part of the total length of the back member.

6. The article as defined in claim 5, wherein the length of the intermediate member is 1/5 to 1/10 of the length of the back member.

* * * * *